US008708329B2

(12) United States Patent
Hanamoto et al.

(10) Patent No.: US 8,708,329 B2
(45) Date of Patent: Apr. 29, 2014

(54) DOCUMENT CONVEYING DEVICE AND IMAGE FORMING APPARATUS INCLUDING THE SAME

(71) Applicant: Kyocera Document Solutions, Inc., Osaka (JP)

(72) Inventors: Katsuhiko Hanamoto, Osaka (JP); Akira Horie, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/672,962

(22) Filed: Nov. 9, 2012

(65) Prior Publication Data

US 2013/0119602 A1 May 16, 2013

(30) Foreign Application Priority Data

Nov. 15, 2011 (JP) ..... 2011-249246

(51) Int. Cl.
*B65H 3/06* (2006.01)

(52) U.S. Cl.
USPC ..... 271/117; 271/118; 271/109; 271/121

(58) Field of Classification Search
USPC ..... 271/117, 118, 121, 109
See application file for complete search history.

(56) References Cited

U.S. PATENT DOCUMENTS

| | | | | |
|---|---|---|---|---|
| 7,571,905 | B2 * | 8/2009 | Kim | 271/117 |
| 7,717,415 | B2 * | 5/2010 | Kim et al. | 271/110 |
| 8,052,139 | B1 * | 11/2011 | Su et al. | 271/117 |
| 8,061,705 | B1 * | 11/2011 | Su et al. | 271/117 |
| 8,210,520 | B2 * | 7/2012 | Su et al. | 271/117 |

FOREIGN PATENT DOCUMENTS

| | | | |
|---|---|---|---|
| JP | 2007-230782 | A | 9/2007 |
| JP | 3160777 | U | 7/2010 |

OTHER PUBLICATIONS

English Abstract for JP 2007-230782 A, published Sep. 13, 2007.

* cited by examiner

*Primary Examiner* — Luis A Gonzalez
(74) *Attorney, Agent, or Firm* — NDQ&M Watchstone LLP

(57) ABSTRACT

A document conveying device of the present disclosure includes a feeding unit, a stopper, and a restriction surface. The feeding unit is swingably supported on a first swinging fulcrum and is disposed selectively at a paper feeding position or at a retracted position. The stopper is swingably supported on a second swinging fulcrum, and has a document restriction portion and an engagement piece. The restriction surface is provided on the main body side of the document conveying device, and extends downward from a position coinciding with a first trajectory toward an inner side of the first trajectory, while extending downward from a position coinciding with a second trajectory toward an inner side of the second trajectory. When the feeding unit is at the retracted position, the engagement piece is engaged with the restriction surface, and when the feeding unit is at the paper feeding position, the engagement therebetween is released.

3 Claims, 5 Drawing Sheets

DOCUMENT CONVEYING DEVICE AND IMAGE FORMING APPARATUS INCLUDING THE SAME

INCORPORATION BY REFERENCE

This application is based on and claims the benefit of priority from Japanese Patent Application No. 2011-249246 filed on Nov. 15, 2011.

BACKGROUND

The present disclosure relates to a document conveying device that is mounted in an image forming apparatus such as a digital copy machine, a laser printer, or the like and feeds a document sheet one by one separately from a stack of document sheets, and to an image forming apparatus including the same.

Conventional image reading devices that are mounted in copy machines and so on utilizing the electrophotographic process may include a document conveying device (automatic document feeder) that sequentially feeds a document in sheet form onto a document placing table in order for it to be read and removes it from the document placing table after it has been read. An image reading device of this type is capable of performing the following two reading methods. One is a sheet-through method in which, with a document presser closed, a document sheet is read while being automatically conveyed by a document conveying device, and the other is a document stationary method in which, upon every completion of reading, the document presser is opened and closed in order for a document sheet on the document placing table (contact glass) to be replaced one by one.

In the former, namely, the sheet-through method, a document reading operation is performed with an optical system in the image reading device held at a predetermined image reading position without performing a scanning movement, whereas in the latter, namely, the document stationary method, a reading operation is performed while the optical system performs a scanning movement. In reading a document sheet based on the sheet-through method, generally, a pickup roller supported in a feeding unit is brought in press-contact with an uppermost surface of a stack of document sheets stacked on a document stacking tray, and the document sheet is conveyed in that state.

Typically, when a stack of document sheets are placed on the document stacking tray, by a manual operation, tip ends of the stack of document sheets in a feeding direction are made to butt against a predetermined butting member (stopper) provided in the feeding unit, and the tip ends of the stack of document sheets are thereby aligned with each other. The stopper is configured to be changeable between an opposedly fixed state where it is fixed so as to be opposed to a stack of document sheets on the document stacking tray and a fixing released state where it is swung so that the opposedly fixed state is released to allow passage of document sheets therethrough. For aligning tip ends of a stack of document sheets on the document stacking tray with each other, the stopper is set to be in the opposedly fixed state, while for feeding a document sheet one by one from the stack of document sheets by driving the feeding unit including the pickup roller and a feeding roller, the stopper is set to be in the fixing released state.

By the way, when, in setting a stack of document sheets on the document stacking tray, a user align send portions of the stack of document sheets with each other by use of the stopper, vibrations might occur to cause the feeding unit disposed at a standby position to be displaced downward, which has been problematic.

In order to prevent this trouble, there is known an automatic paper sheet feeding device that includes a stopper having a stopper piece that, from a support shaft supported in a support body (feeding unit) in which a pickup roller is supported, extends downward to become opposed to tip ends of paper sheets on a feeding tray and an engagement piece that is provided to protrude upward from the support shaft, and in which a restriction surface that restricts swinging of the stopper, which has been set to be in the opposedly fixed state, by being engaged with the engagement piece is provided on a main body side of the device.

In the above-described configuration, the engagement piece of the stopper and the restriction surface provided on the main body side of the device interfere with each other and thus can prevent the stopper from being brought into the fixing released state. With this configuration, however, for example, in a case where various parts of the document conveying device are driven by use of one motor, members to be driven including the feeding unit are each connected to the motor via a clutch.

In such a case, since the feeding unit is not always connected to be driven, there has been the following problem. That is, when, in setting a stack of document sheets, a user forcibly pushes in the stack of document sheets toward the stopper, a load in a document feeding direction is applied to the stopper, so that a force in a downward direction is exerted on the feeding unit in which the stopper is supported. As a result, the feeding unit might be displaced downward below a standby position thereof, causing the stopper, which has been set to be in the opposedly fixed state, to be brought into the fixing released state. Because of this, tip ends of the stack of document sheets accidentally reach as far as the vicinity of a nip portion (document separation portion) of a feeding roller pair, leading to the occurrence of double feeding or skew feeding of document sheets.

SUMMARY

It is an object of the present disclosure to provide a document conveying device that, even when an excessive pressure is applied to a stopper used to align tip ends of a stack of document sheets with each other, prevents positional displacement of the stopper and a feeding unit in which the stopper is supported and thus is capable of performing a stable operation, and an image forming apparatus including the same.

A document conveying device according to one aspect of the present disclosure includes a document stacking tray, a feeding unit, a stopper, and a restriction surface. On the document stacking tray, a plurality of document sheets are stacked. The feeding unit has a unit frame body that is swingably supported, at an end portion thereof on a downstream side in a document conveying direction, on a first swinging fulcrum on a main body side of the document conveying device, and a pickup roller that is rotatably supported on a swingable end side of the unit frame body. The feeding unit is disposed selectively at a paper feeding position where the pickup roller is brought in press-contact with an upper surface of a stack of document sheets stacked on the document stacking tray or at a retracted position where the upper surface of the stack of document sheets and the pickup roller are separated by a predetermined distance from each other. The stopper is swingably supported on a second swinging fulcrum provided on the swingable end side of the unit frame body, and has a document restriction portion that extends from the second swinging fulcrum to become opposed to tip ends of the stack of document sheets stacked on the document stacking tray and an engagement piece that is provided to protrude from the second swinging fulcrum in the opposite direction to the document restriction portion. The restriction surface is provided on the main body side of the document conveying device and extends downward from a position coinciding with a first trajectory, along which the engagement piece moves as the stopper is swung about the second swinging fulcrum, toward the inner side of the first trajectory. When the feeding unit is at the retracted position, the engagement piece is engaged with the restriction surface, so that the document restriction portion is brought into a position opposed to the tip ends of the stack of document sheets, and thus an opposedly fixed state is brought about where swinging of the stopper is restricted. When the feeding unit is at the paper feeding position, the engagement between the engagement piece and the restriction surface is released, and thus a fixing released state is brought about where the swinging of the stopper is allowed. The restriction surface extends downward from a position coinciding with a second trajectory, along which the engagement piece moves as the feeding unit is swung about the first swinging fulcrum, toward the inner side of the second trajectory.

Still other objects of the present disclosure and specific advantages provided by the present disclosure will be made further apparent from the following description of an embodiment.

DETAILED DESCRIPTION

Figure 1:
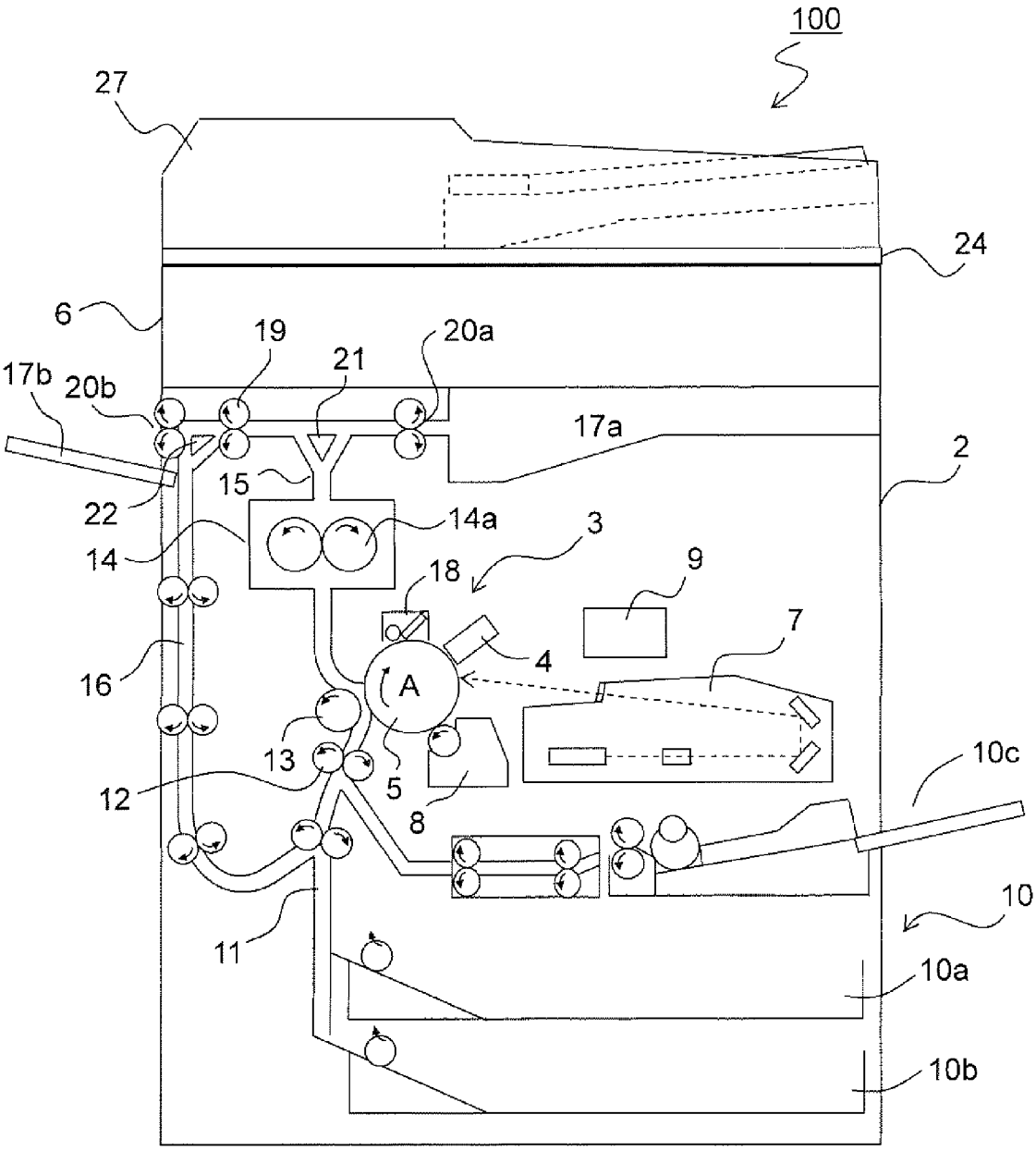
FIG. 1 is a sectional side view showing an entire configuration of an image forming apparatus 100 in which a document conveying device 27 of the present disclosure is mounted.

The following describes an embodiment of the present disclosure with reference to the appended drawings. FIG. 1 is a schematic structural view of an image forming apparatus 100 in which a document conveying device 27 of the present disclosure is mounted. In FIG. 1, when the image forming apparatus 100 (herein, a digital multifunction machine is shown as one example) performs a copying operation, an image reading device 6 reads image data on a document sheet and converts it into an image signal. Meanwhile, in an image forming portion 3 in a multifunction machine main body 2, while rotating in an A direction in FIG. 1, a photosensitive drum 5 is uniformly charged by a charging unit 4. By a laser beam from an exposure unit (a laser scanning unit or the like) 7, which is based on the document image data read in the image reading device 6, an electrostatic latent image is formed on the photosensitive drum 5. After that, by a developing unit 8, a developer (hereinafter, referred to as toner) is made to adhere to the electrostatic latent image, and thus a toner image is formed. Toner used here is supplied to the developing unit 8 from a toner container 9.

Toward the photosensitive drum 5 on which the toner image has been formed as described above, a paper sheet is conveyed from a paper feeding mechanism 10 to the image forming portion 3 via a paper sheet conveying path 11 and a registration roller pair 12, and in the image forming portion 3, the toner image on the surface of the photosensitive drum 5 is transferred onto the paper sheet by a transfer roller 13 (an image transfer portion). Then, the paper sheet onto which the toner image has been transferred is separated from the photosensitive drum 5 and conveyed to a fixing portion 14 having a fixing roller pair 14*a*, where the toner image is fixed. The paper sheet that has been passed through the fixing portion 14 is sent to a paper sheet conveying path 15 branching off in a plurality of directions, and a conveying direction thereof is set by path-switching mechanisms 21 and 22 that are provided at branching points in the paper sheet conveying path 15 and each have a plurality of path-switching guides. The paper sheet whose conveying direction has thus been set is ejected directly (or after having been sent to a reversing conveying path 16 and thus having undergone double-sided copying thereon) to a paper sheet ejection portion that is composed of a first ejection tray 17*a* and a second ejection tray 17*b*.

Furthermore, though not shown, a static eliminator that eliminates residual electric charge on the surface of the photosensitive drum 5 is provided on a downstream side of a cleaner 18. Moreover, the paper feeding mechanism 10 includes a plurality of paper feeding cassettes 10*a* and 10*b* that are demountably mounted in the multifunction machine main body 2 and in each of which paper sheets are housed and a stack bypass (manual feeding tray) 10*c* that is provided above the paper feeding cassettes 10*a* and 10*b*. The paper feeding cassettes 10*a* and 10*b* and the stack bypass 10*c* are linked to the image forming portion 3 that is composed of the photosensitive drum 5, the developing unit 8, and so on by the paper sheet conveying path 11. On an upper surface of the multifunction machine main body 2, a platen (document presser) 24 that holds under pressure a document sheet placed on a contact glass 25 (see FIG. 2) of the image reading device 6 is provided such that it can be opened and closed, and the document conveying device 27 is additionally provided over the platen 24.

Specifically, the paper sheet conveying path 15 is configured such that, on a downstream side of the fixing roller pair 14*a*, it first branches off right and left into two paths, one of which (in FIG. 1, a path branched off to the right) communicates with the first ejection tray 17*a*. The other path (in FIG. 1, a path branched off to the left) further branches off after passing through a conveying roller pair 19 into two paths, one of which (in FIG. 1, a path extending straight to the left) communicates with the second ejection tray 17*b*. The other path (in FIG. 1, a path branched off downward), on the other hand, communicates with the reversing conveying path 16.

Figure 2:
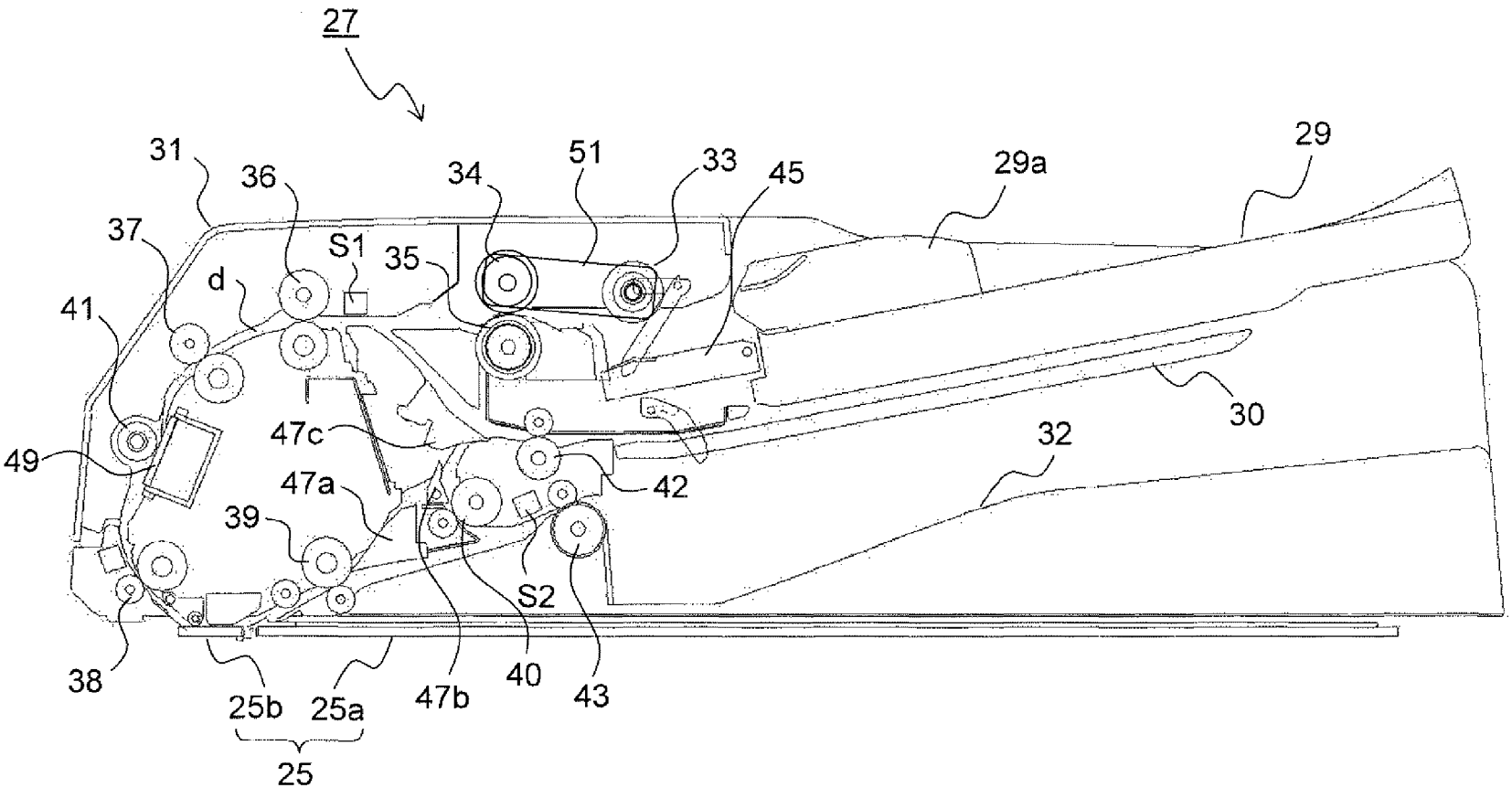
FIG. 2 is a sectional side view showing an internal structure of the document conveying device 27 according to one embodiment of the present disclosure.

FIG. 2 is a sectional side view showing an internal structure of the document conveying device 27. The document conveying device 27 has a document stacking tray 29 that is provided with a document guide 29*a* used to stack a plurality of document sheets such that they are aligned in a width direction thereof and a reversing tray 30 that is provided below the document stacking tray 29. The document stacking tray 29 and the reversing tray 30 are attached to a frame of the document conveying device 27. Furthermore, with respect to the frame of the document conveying device 27, a cover member 31 is supported such that it can be opened and closed about one end of the frame (lower left in the figure) as a pivotal fulcrum, and on a lateral side of the cover member 31, a document ejection tray 32 is formed integrally with part of an upper surface of the platen 24 (see FIG. 1). In the cover member 31, a document conveying path d extending from the document stacking tray 29 up to the document ejection tray 32 is formed, and when the cover member 31 is opened, the document conveying path d is exposed so that a jam can be cleared.

In the cover member 31, there is provided, along the document conveying path d, a document conveying section that is composed of a pickup roller 33, a feeding roller 34 with a separation roller 35, a registration roller pair 36, conveying roller pairs 37, 38, 39, and 40, a CIS roller 41, a reversing roller pair 42, an ejection roller pair 43, and so on.

The pickup roller 33 is mounted to a swingable end of a unit frame body 51 that is supported swingably about a rotary shaft of the feeding roller 34 as a fulcrum. The pickup roller 33, the feeding roller 34, and the unit frame body 51 constitute a feeding unit 50 (see FIG. 3) that feeds document sheets. In a document feeding process, the unit frame body 51 is swung downward by rotation of the feeding roller 34 so that the feeding unit 50 is moved from a retracted position (home position) to a paper feeding position, where the pickup roller 33 is pressed against an upper surface of a stack of document sheets. On the other hand, after completion of the document feeding process, the unit frame body 51 is swung upward by reverse rotation of the feeding roller 34 so that the feeding unit 50 is moved from the paper feeding position to the retracted position. The detailed configuration of the feeding unit 50 will be described later.

The separation roller 35 is in contact from below with the feeding roller 34 under a predetermined pressure, thus constituting a document separation portion that conveys a document sheet one by one separately. The separation roller 35 has a built-in torque limiter so that, when a rotational load thereof falls below a predetermined torque value, its rotation is halted, and only when the rotational load thereof exceeds the predetermined torque value, it rotates by following rotation of the feeding roller 34.

The contact glass 25 is composed of a manual document reading glass 25*a* and an automatic reading glass 25*b* and includes a white reference plate for correcting shading, which is disposed so as to be opposed to the automatic reading glass 25*b* (image reading position), and a document pressing portion (neither of these are shown) that lies above the white reference plate and is used to press the white reference plate toward the automatic reading glass 25*b*. The document conveying path d is curved along a length from the registration roller pair 36 up to the automatic reading glass 25*b* so as to cause reversing of a document sheet. Furthermore, a plurality of paper sheet detection sensors for detecting presence/absence or passage of a document sheet, including a paper feeding sensor S1 and an ejection sensor S2, are provided at appropriate locations along the document conveying path d.

Next, a description is given of a document conveying operation based on the sheet-through method that is performed using the document conveying device 27. First, with reference to FIG. 2, there is described a case of reading a one-sided document sheet. After a plurality of document sheets are set on the document stacking tray 29 such that image sides thereof face upward, a copying starting button on an operation panel of the image forming apparatus 100 is turned on, and thus a motor (not shown) starts rotating the feeding roller 34 and the pickup roller 33 in a paper feeding direction. Moreover, the pickup roller 33 moves to the paper feeding position, so that an upper surface of the document sheets are pressed against the pickup roller 33 under a predetermined pressure (paper feeding pressure).

Typically, by the pickup roller 33, a plurality of upper ones of a stack of document sheets set on the document stacking tray 29 are sent to a nip portion between the feeding roller 34 and the separation roller 35. Then, only the uppermost one of the plurality of upper document sheets is separated from the rest by the separation roller 35 and is conveyed toward the registration roller pair 36. At this time, after the uppermost document sheet has been conveyed by a predetermined distance since detection of a tip end thereof by the paper feeding sensor S1, the rotary driving of the pickup roller 33 and the feeding roller 34 is halted, and thus primary paper feeding is completed. The document sheet that has been subjected to the primary paper feeding is stopped in a state where the tip end thereof is pressed against a nip portion of the registration roller pair 36 and a warp is formed at the tip end portion.

After a lapse of a predetermined length of time from the completion of the primary paper feeding, the motor (not shown) operates to perform rotary driving of the registration roller pair 36, and thus secondary paper feeding is started. By the registration roller pair 36, the conveying roller pairs 37 to 39, and the CIS roller 41, the document sheet is passed through the automatic reading glass 25*b* to be conveyed toward the ejection roller pair 43, after which, by the ejection roller pair 43, the document sheet is eventually ejected onto the document ejection tray 32. At this time, based on detection of passage of a back end of the document sheet by the ejection sensor S2, it is detected that image reading of one document sheet has been completed.

Herein, the ejection sensor S2 has a function of counting the number of document sheets upon every completion of conveying a document sheet, and as long as the paper feeding sensor S1 has detected a document sheet subsequent to the one that has just been conveyed, in a similar manner to the above, conveying of the second and subsequent document sheets is continuously performed. When being passed through the automatic reading glass 25*b*, a document sheet is conveyed while being slightly pressed toward the automatic reading glass 25*b* so that an image on the document sheet is read by the image reading device 6 (see FIG. 1) through the automatic reading glass 25*b*.

Furthermore, in a case of reading a double-sided document sheet, there are used a one-step reading method and a two-step reading method. In the one-step reading method, an image on the rear side of the document sheet is read by a contact image sensor 49 provided so as to be opposed to the CIS roller 41, and an image on the front side of the document sheet is read through the automatic reading glass 25*b*. In the two-step reading method, after an image on the front side of the document sheet has been read by the automatic reading glass 25*b*, the document sheet is guided onto the reversing tray 30 by branching claws 47*a*, 47*b*, and 47*c*, and then the reversing roller pair 42 is reversely rotated to convey the document sheet with its rear side facing upward again to an upstream side of the registration roller pair 36*so* that an image on the rear side of the document sheet is read through the automatic reading glass 25*b*.

Reading by use of the contact image sensor 49, while allowing a length of time required for reading to be reduced, results in poor image quality compared with a case of reading by use of the automatic reading glass 25*b*. For this reason, preferably, in a case of reading a text document or the like, the one-step reading method using the contact image sensor 49 is employed, and when high image quality and high definition reading is required as in a case of reading a photographic document or the like, the two-step reading method using the reversing tray 30 is employed.

In a case where the two-step reading method is employed, if document sheets that have been read were sequentially ejected directly onto the document ejection tray 32, the document sheets ejected would be stacked with their front and rear sides reversed from the state of the document sheets when set on the document stacking tray 29. In order to avoid this, after an image on the rear side of a document sheet has been read through the automatic reading glass 25*b*, the document sheet is introduced again onto the reversing tray 30 by swinging the branching claws 47*a* to 47*c* and then is ejected onto the document ejection tray 32 via the conveying roller pair 40 and the ejection roller pair 43. By this configuration, before document sheets are ejected, front and rear sides thereof are again reversed, and thus the document sheets can be stacked on the document ejection tray 32 while maintaining the state of the document sheets when set on the document stacking tray 29.

Figure 3:
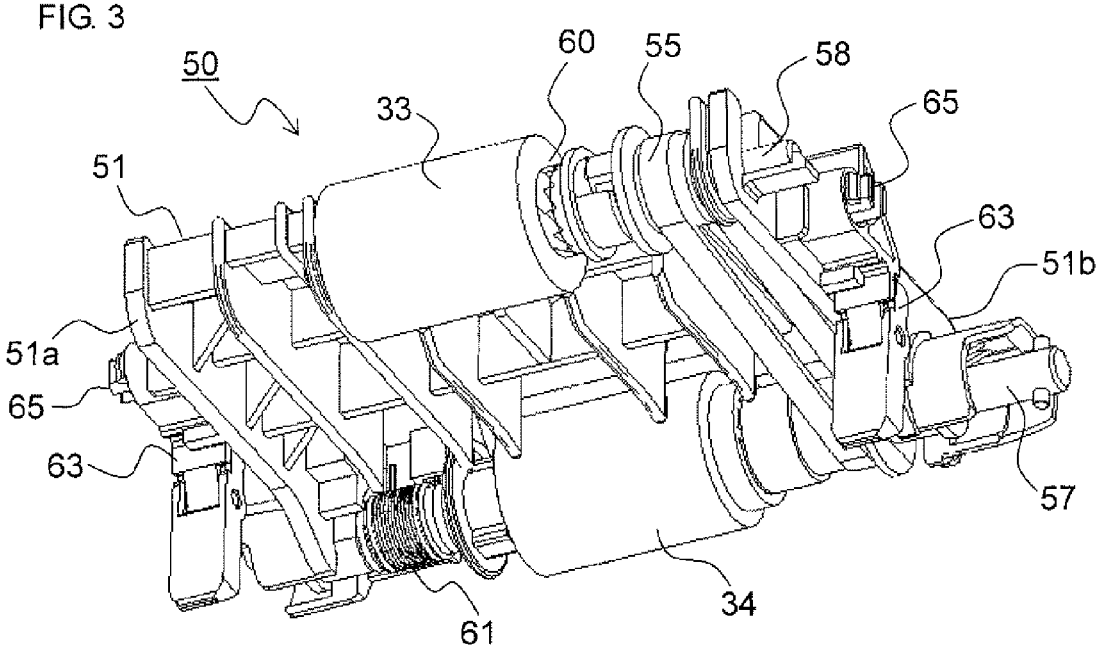
FIG. 3 is a perspective view of a feeding unit 50 used in the document conveying device 27 of the present disclosure, as seen from obliquely below.
Figure 4:
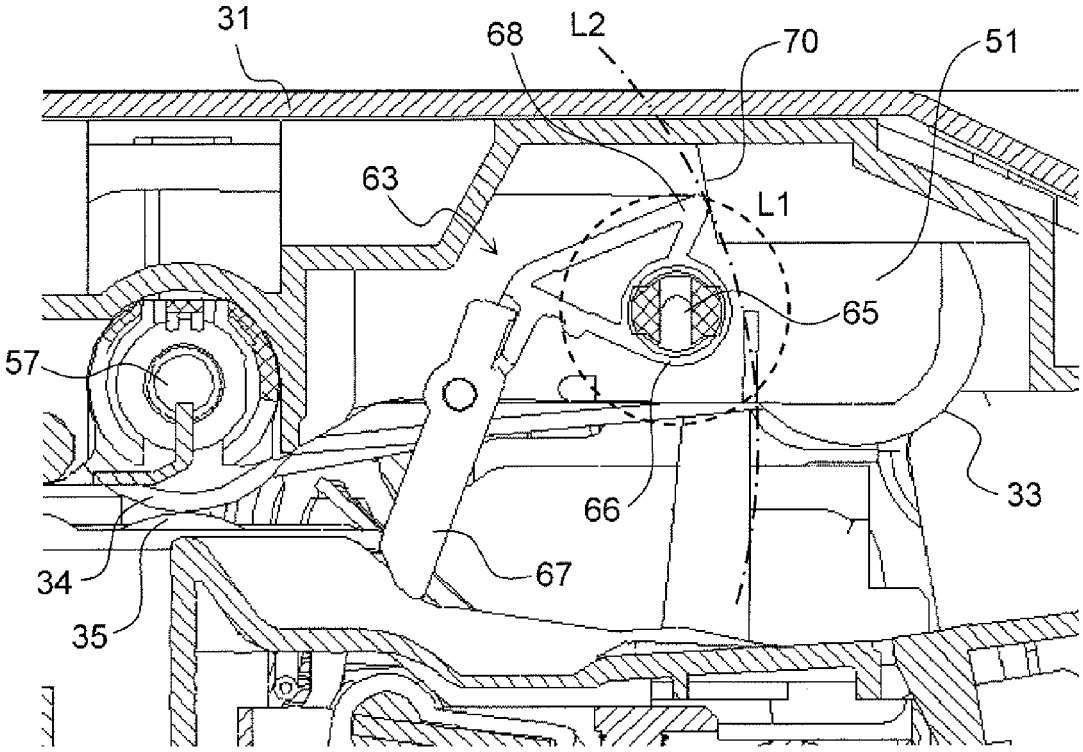
FIG. 4 is a fragmentary sectional view of the vicinity of the feeding unit 50 of the document conveying device 27, which shows a state where the feeding unit 50 is at a retracted position.
Figure 5:
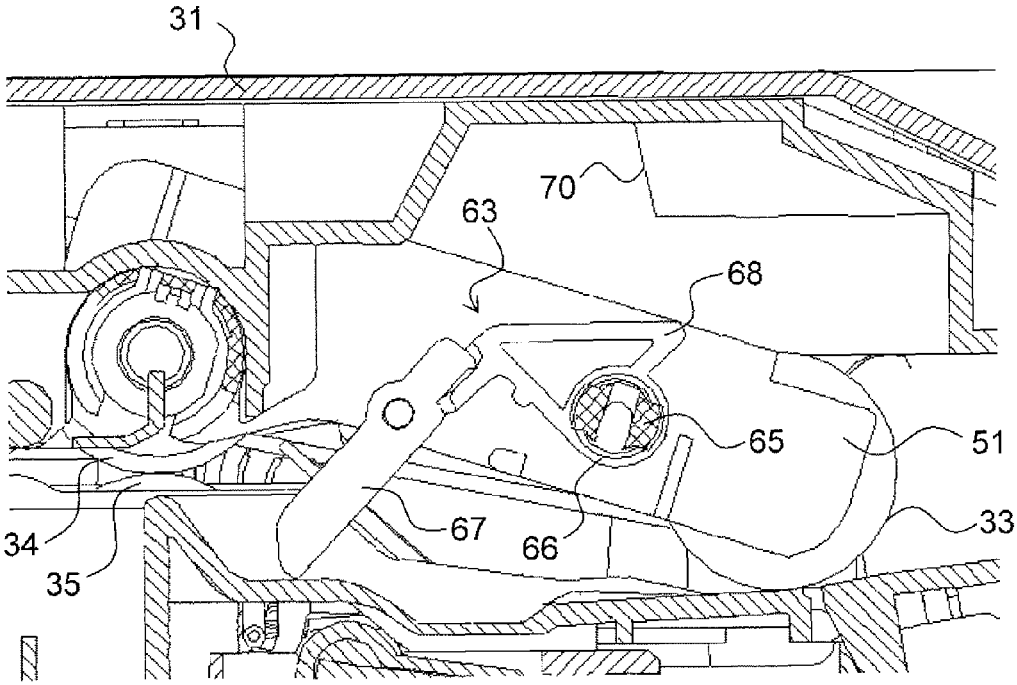
FIG. 5 is a fragmentary sectional view of the vicinity of the feeding unit 50 of the document conveying device 27, which shows a state in which the feeding unit 50 is at a paper feeding position.
Figure 6:
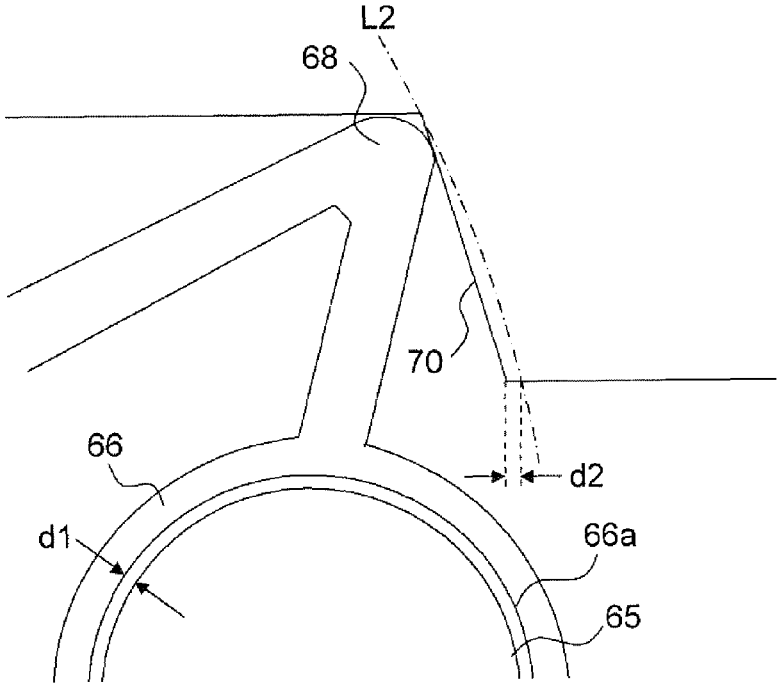
FIG. 6 is a partially enlarged view of the periphery of a contact area where an engagement piece 68 and a restriction surface 70 come in contact with each other, which is shown in FIG. 4.
Figure 7:
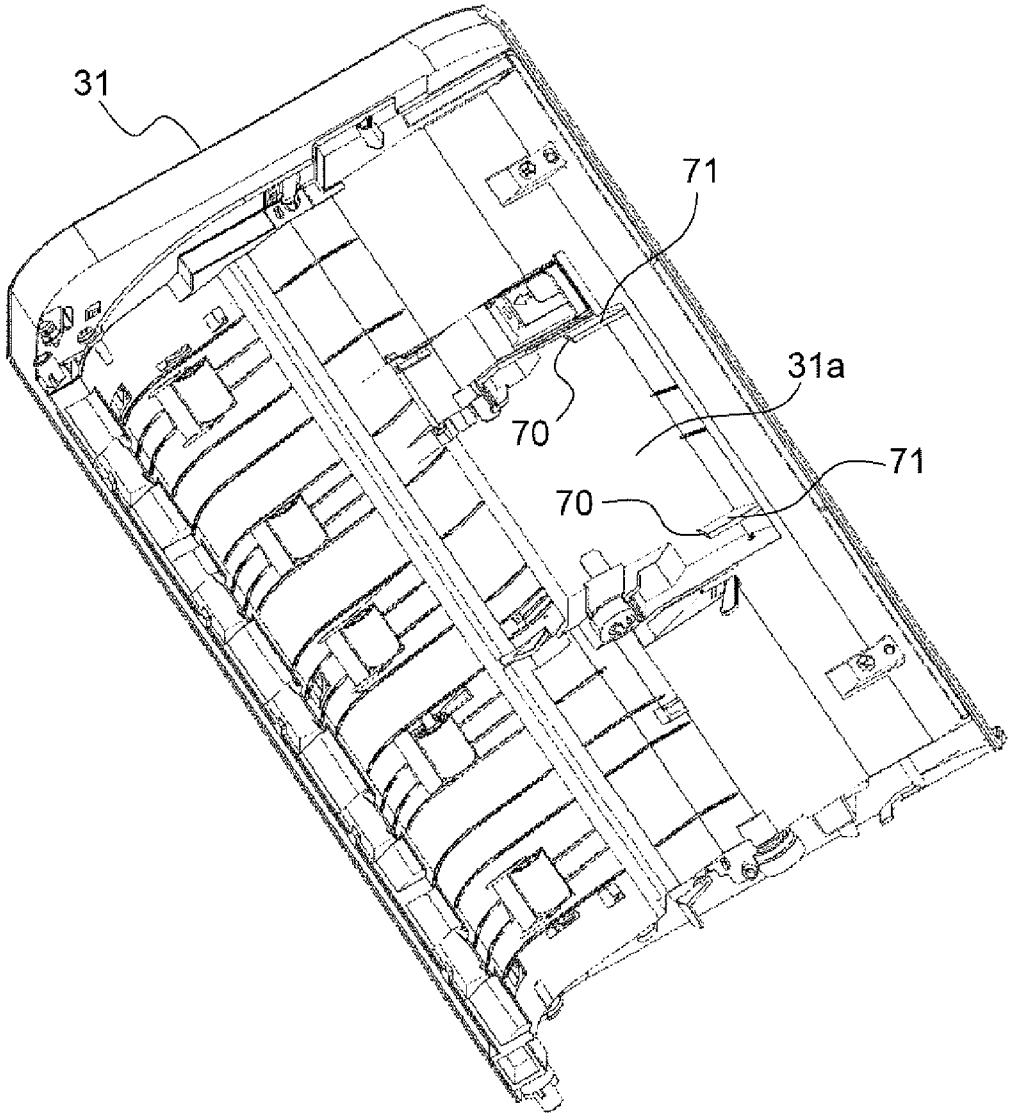
FIG. 7 is a perspective view of a cover member 31 of the document conveying device 27, as seen from a rear surface side thereof.

FIG. 3 is a perspective view showing one embodiment of the feeding unit 50 and shows a state of the feeding unit 50 as seen from obliquely below. Furthermore, each of FIGS. 4 and 5 is a fragmentary sectional view of the vicinity of the feeding unit 50 of the document conveying device 27, with FIG. 4 showing a state where the feeding unit 50 is at the retracted position, and FIG. 5 showing a state where the feeding unit 50 is at the paper feeding position. FIG. 6 is a partially enlarged view of the periphery of a contact area where an engagement piece 68 and a restriction surface 70 come in contact with each other, which are shown in FIG. 4, and FIG. 7 is a perspective view of the cover member 31 as seen from a rear surface side thereof. Based on FIGS. 3 to 7, and with reference to FIGS. 1 and 2 where necessary, the following describes in detail a configuration of the feeding unit 50 and the periphery thereof.

As shown in FIG. 3, the feeding unit 50 is configured to include the unit frame body 51, the pickup roller 33 and the feeding roller 34 that are supported to the unit frame body 51, and a driving belt 55 that is used to rotate the pickup roller 33 and the feeding roller 34 together. In this embodiment, the unit frame body 51 is made of a synthetic resin and includes side plates 51*a* and 51*b* paired in a width direction thereof.

The feeding roller 34 is fixed on a longer first rotary shaft 57 that is provided to penetrate through between the side plates 51*a* and 51*b* of the unit frame body 51 on a base end side of the unit frame body 51 (on the left in FIG. 4). The first rotary shaft 57 is pivotably supported between a pair of side plates of the main body of the document conveying device 27.

The pickup roller 33 is supported on a shorter second rotary shaft 58 that is pivotably supported between the side plates 51*a* and 51*b* of the unit frame body 51 on a swingable end side of the unit frame body 51 (on the right in FIG. 4). By swinging of the unit frame body 51 in the clockwise direction in FIG. 2 about the first rotary shaft 57 as a swinging fulcrum, the feeding unit 50 is positioned at the feeding position where the pickup roller 33 is brought in press-contact with an upper surface of a stack of document sheets. Furthermore, by swinging of the unit frame body 51 in a reverse direction, the feeding unit 50 is positioned at the retracted position where the press-contact state of the pickup roller 33 with the document sheets is released.

The pickup roller 33 is axially supported on the second rotary shaft 58 via a one-way clutch 60. The one-way clutch 60 is set so that rotation of the second rotary shaft 58 toward a predetermined direction (clockwise direction in FIG. 2) is transmitted to the pickup roller 33, while rotation of the second rotary shaft 58 toward a reverse direction is not transmitted thereto. This is to prevent the occurrence of a malfunction that the pickup roller 33 rotates in a reverse direction (counterclockwise direction in FIG. 2) around the second rotary shaft 58 to cause document sheets on the document stacking tray 29 to travel in a reverse direction.

The driving belt 55 is looped over the first rotary shaft 57 and the second rotary shaft 58 and is configured to rotate by a driving force from the first rotary shaft 57. Furthermore, the first rotary shaft 57 and the second rotary shaft 58 are set to have an equal diameter in their respective areas where the driving belt 55 is looped, so that the pickup roller 33 and the feeding roller 34 rotate at equal rpm.

Between an end face of the feeding roller 34 on the opposite side to the driving belt 55 and the side plate 51*a* of the unit frame body 51, which is opposed to this end face, a coil spring 61 that is loosely fitted on the first rotary shaft 57 is interposed in a compressed state. By this configuration, rotation of the feeding roller 34 is transmitted to the unit frame body 51 by friction forces generated between the coil spring 61 and the end face of the feeding roller 34 and between the coil spring 61 and an inner surface of the side plate 51*a*.

Thus, the unit frame body 51, when in a state where no external force is acting thereon, rotates integrally with the feeding roller 34 about the first rotary shaft 57, whereas, by rotation of the unit frame body 51 in a direction toward the paper feeding position (clockwise direction in FIG. 4), the pickup roller 33 is brought in press-contact with a stack of document sheets on the document stacking tray 29. By this configuration, when the feeding unit 50 is positionally set to the paper feeding position (see FIG. 5), due to a friction force between the end surface of the feeding roller 34 and the side plate 51*a* of the unit frame body 51, a large rotational force is imparted to the feeding roller 34, and thus a state is brought about where while rotation of the feeding roller 34 is continued, rotation of the unit frame body 51 is restricted.

On the contrary, when, by rotation of the unit frame body 51 in a direction toward the retracted position (counterclockwise direction in FIG. 4), the unit frame body 51 comes in contact with a top surface of the cover member 31, and thus the feeding unit 50 is positionally set to the retracted position (see FIG. 4), a state is brought about where while rotation of the feeding roller 43 toward the counterclockwise direction is continued, rotation of the unit frame body 51 is restricted.

A stopper 63 is axially supported swingably around each of a pair of stopper spindles 65 that are provided to protrude outward from the side plates 51*a* and 51*b* of the unit frame body 51, respectively. The stopper spindle 65 is provided on an outer surface of each of the side plates 51*a* and 51*b* of the unit frame body 51 at a slightly upper position between the first rotary shaft 57 and the second rotary shaft 58 close to the secondary rotary shaft 58.

The stopper 63 has a bearing portion 66 having a bearing hole 66*a* that is rotatably externally fitted on the stopper spindle 65, a document restriction portion 67 that extends from the bearing portion 66 to become opposed to tip ends of a stack of document sheets on the document stacking tray 29, and the engagement piece 68 that is provided to protrude from the bearing portion 66 in the opposite direction to the document restriction portion 67. The stopper 63 is swung about the stopper spindle 65 as a fulcrum and thus can be positionally changed between a position where the document restriction portion 67 sags down to be opposed to tip ends of document sheets on the document stacking tray 29 and a position where the document restriction portion 67 is retracted from the tip ends of the document sheets.

As shown in FIG. 7, on the rear surface side of the cover member 31, there is formed a unit disposition portion 31*a* in which the feeding unit 50 is disposed, and in the unit disposition portion 31*a*, a rib 71 having the restriction surface 70 at a position opposed to the engagement piece 68 of the stopper 63 is provided to protrude. The restriction surface 70 extends downward from a position coinciding with a trajectory (indicated by a broken line L1 in FIG. 4; hereinafter, referred to as a first trajectory L1), along which the engagement piece 68 moves as the stopper 63 is swung about the stopper spindle 65 (second swinging fulcrum), toward the inner side of the first trajectory L1.

When the feeding unit 50 is swung about the first rotary shaft 57 as a fulcrum such that it is positionally set to the retracted position shown in FIG. 4, the engagement piece 68 comes in contact with the restriction surface 70, so that the document restriction portion 67 is brought into a position opposed to tip ends of a stack of document sheets, and thus a state (opposedly fixed state) is brought about where swinging of the stopper 63 is restricted. On the other hand, when the feeding unit 50, which has been positionally set to the retracted position, is swung in the clockwise direction about the first rotary shaft 57 as the fulcrum such that it is positionally set to the paper feeding position shown in FIG. 5, the contact state of the engagement piece 68 with the restriction surface 70 is released, and thus a state (fixing released state) is brought about where swinging of the stopper 63 is allowed.

That is, in a case where the feeding unit 50 is positionally set to the retracted position, and thus the stopper 63 is in the opposedly fixed state (see FIG. 4), the document restriction portion 67 is in a state where its swinging in the clockwise direction is inhibited. Hence, even when a stack of document sheets are placed on the document stacking tray 29, and tip ends thereof are pressed against the document restriction portion 67, the document restriction portion 67 stays locked in position. Thus, by pressing a stack of document sheets against a pair of the document restriction portions 67, tip ends of the stack of document sheets can be reliably aligned with each other.

In a document conveying process, the feeding roller 34 is rotated to swing the unit frame body 51 in the clockwise direction, and thus the feeding unit 50 is moved from the retracted position to the paper feeding position. At this time, the engagement piece 68 slides downward along the restriction surface 70, so that the stopper 63, while being slightly swung in the counterclockwise direction in FIG. 4, moves downward together with the feeding unit 50. When the engagement piece 68 becomes detached from the restriction surface 70, the stopper 63 is brought into the fixing released state.

Furthermore, in a case where the feeding unit 50 is positionally set to the paper feeding position, and thus the stopper 63 is in the fixing released state (see FIG. 5), when the pickup roller 33 is driven to rotate in the clockwise direction around the second rotary shaft 58, by the pickup roller 33, the uppermost one or a plurality of upper ones of document sheets are guided to be drawn in to a downstream side. By a tip end(s) of the document sheet(s) drawn in, the document restriction portion 67 is pushed to be swung in the clockwise direction about the stopper spindle 65 as the fulcrum and then is pushed further, thus causing the document sheet(s) to slip through a lower end edge of the document restriction portion 67 to be introduced into the nip portion between the feeding roller 34 and the separation roller 35.

Furthermore, after completion of the document conveying process, the feeding roller 34 is reversely rotated to swing the unit frame body 51 in the counterclockwise direction, and thus the feeding unit 50 is moved from the paper feeding position to the retracted position. At this time, under the self-weight of the document restriction portion 67, the stopper 63 is swung in the counterclockwise direction in FIG. 5, so that interference between the engagement piece 68 and the restriction surface 70 is avoided. When the feeding unit 50 becomes disposed at the retracted position, as shown in FIG. 4, the engagement piece 68 is again engaged with the restriction surface 70, and thus the stopper 63 is brought into the opposedly fixed state.

In the document conveying device 27 of this embodiment, as shown in FIG. 6, the restriction surface 70 extends downward from a position coinciding with a trajectory (indicated by an alternate long and short dashed line L2 in FIGS. 4 and 6; hereinafter, referred to as a second trajectory L2), along which the engagement piece 68 moves as the feeding unit 50 is swung about the first rotary shaft 57 (first swinging fulcrum), toward the inner side of the second trajectory L2.

According to this configuration, in a case where, when a stack of document sheets are set on the document stacking tray 29, tip ends of the stack of document sheets are pressed strongly against the document restriction portion 67 of the stopper 63 in the opposedly fixed state, thus exerting a force that acts to swing the unit frame body 51 in the clockwise direction (downward) in FIG. 4, since the restriction surface 70 extending to the inner side of the second trajectory L2 and the engagement piece 68 come in contact with each other, a downward movement of the unit frame body 51 is restricted.

As a result, when a stack of document sheets are pressed against the document restriction portion 67 so that their tip ends are aligned with each other, a downward displacement of the feeding unit 50 from the retracted position and swinging of the document restriction portion 67 caused thereby can be avoided. This can prevent a phenomenon that, in setting a stack of document sheets, tip ends of the stack of document sheets are accidentally bought to reach as far as the vicinity of the nip portion between the feeding roller 34 and the separation roller 35, leading to the occurrence of double feeding or skew feeding of document sheets.

Furthermore, preferably, a maximum value d1 of a gap between an inner peripheral surface of the bearing hole 66*a* of the stopper 63 and an outer peripheral surface of the stopper spindle 65 is set to be larger than a maximum value d2 of a length by which the restriction surface 70 protrudes to the inner side of the second trajectory L2. In this embodiment, the inner diameter of the bearing hole 66*a* is set to 6.55 mm, and the diameter of the stopper spindle 65 is set to 5.96 mm, so that d1 and d2 are 0.59 mm and 0.28 mm, respectively.

By this configuration, in moving the feeding unit 50 from the retracted position to the paper feeding position, the stopper 63 is permitted a movement by a distance defined by the gap d1 in a direction away from the restriction surface 70, and thus interference between the engagement piece 68 and the restriction surface 70 can be avoided. Thus, the feeding unit 50 can be moved smoothly from the retracted position to the paper feeding position.

The present disclosure is not limited to the above-described embodiment and may be variously embodied without departing from the spirit of the present disclosure. For example, the driving mechanism of the feeding unit 50 shown in FIG. 3 is merely one example, and it is possible to use a gear mechanism in place of the driving belt 55. Furthermore, other parts of the document conveying device 27 also can be arbitrarily modified in design. For example, a paper feeding belt may be used in place of the feeding roller 34, and a separation pad may be used in place of the separation roller 35.

The present disclosure is applicable to a document conveying device that conveys a document sheet one by one separately from a stack of document sheets. With the use of the present disclosure, a low-cost document conveying device with a simple structure can be provided, in which, in setting a stack of document sheets, undesired swinging of a stopper is restricted, so that the stack of document sheets can be reliably set, and that can prevent a phenomenon that tip ends of the stack of document sheets are accidentally brought to reach as far as the vicinity of a document separation portion, leading to the occurrence of double feeding or skew feeding of document sheets.

What is claimed is:

1. A document conveying device, comprising:

a document stacking tray on which a plurality of document sheets are stacked:

a feeding unit that has a unit frame body that is swingably supported, at an end portion thereof on a downstream side in a document conveying direction, on a first swinging fulcrum on a main body side of the document conveying device, and a pickup roller that is rotatablv supported on a swingable end side of the unit frame body, and is disposed selectively at a paper feeding position where the pickup roller is brought in press-contact with an upper surface of a stack of document sheets stacked on the document stacking tray or at a retracted position where the upper surface of the stack of document sheets and the pickup roller are separated by a predetermined distance from each other;

a stopper that is swingably supported on a second swinging fulcrum provided on the swingable end side of the unit frame body, and has a document restriction portion that extends from the second swinging fulcrum to become opposed to tip ends of the stack of document sheets stacked on the document stacking tray and an engagement piece that is provided to protrude from the second swinging fulcrum in an opposite direction to the document restriction portion: and a restriction surface that is provided on the main body side of the document conveying device, and extends downward from a position coinciding with a first trajectory, along which the engagement piece moves as the stopper is swung about the second swinging fulcrum, toward an inner side of the first trajectory, while extending downward from a position coinciding with a second trajectory, along which the engagement piece moves as the feeding unit is swung about the first swinging fulcrum, toward an inner side of the second trajectory, wherein when the feeding unit is at the retracted position, the engagement piece is engaged with the restriction surface, so that the document restriction portion is brought into a position opposed to the tip ends of the stack of document sheets, and thus an opposed fixed state is brought about where swinging of the stopper is restricted, and when the feeding unit is at the paper feeding a position, the engagement between the engagement piece and the restriction surface is released, and thus a fixing released state is brought about where the swinging of the stopper is allowed, and the second swinging fulcrum is made up of a stopper spindle that is formed on the unit frame body and a bearing hole that is formed in the stopper and through which the stopper spindle slidably penetrates, and a maximum value d1 of a gap between an outer peripheral surface of the stopper spindle and an inner peripheral surface of the bearing hole is not less than a maximum value d2 of a length by which the restriction surface protrudes to the inner side of the second trajectory.

2. The document conveying device according to claim 1, wherein when the feeding unit is swung upward from the paper feeding position, under self-weight of the stopper, the document restriction portion is swung in such a direction as to be moved toward the document stacking tray, so that disposing the feeding unit at the retracted position is achieved, while interference between the engagement piece and the restriction surface is avoided.

3. An image forming apparatus comprising the document conveying device according to claim 1.

* * * * *